US005360179A

United States Patent [19]

Vesterinen et al.

[11] Patent Number: 5,360,179

[45] Date of Patent: Nov. 1, 1994

[54] METHOD AND DEVICE FOR REELING A WEB

[75] Inventors: Kalevi A. Vesterinen; Vesa K. T. Markkanen, both of Helsinki, Finland

[73] Assignee: Valmet Paper Machinery Inc., Helsinki, Finland

[21] Appl. No.: 976,272

[22] Filed: Nov. 13, 1992

[30] Foreign Application Priority Data

Nov. 18, 1991 [FI] Finland ..... 915432

[51] Int. Cl.[5] ..... B65H 18/00

[52] U.S. Cl. ..... 242/526.3; 242/532.2

[58] Field of Search ..... 242/56 R, 56.2, 56.4, 242/56.5, 56.6

[56] References Cited

U.S. PATENT DOCUMENTS

| | | | |
|---|---|---|---|
| 2,984,426 | 5/1961 | Johnson | 242/56 |
| 4,445,646 | 5/1984 | Karr et al. | 242/56 R |
| 4,695,004 | 9/1987 | Grossman et al. | 242/56 R |

FOREIGN PATENT DOCUMENTS

| | | |
|---|---|---|
| 0067051 | 12/1982 | European Pat. Off. . |
| 0089304 | 9/1983 | European Pat. Off. . |
| 2721883 | 11/1978 | Germany . |
| 3515519 | 10/1986 | Germany . |
| 9103359 | 3/1991 | WIPO . |
| 9206913 | 4/1992 | WIPO . |

*Primary Examiner*—Daniel P. Stodola
*Assistant Examiner*—John Q. Nguyen
*Attorney, Agent, or Firm*—Steinberg, Raskin & Davidson

[57] ABSTRACT

A method and device in the reeling of a web, wherein the web is reeled a first roll onto a second roll. When the second roll has reached the desired diameter size, a new reeling is started from this second roll of desired size onto an additional roll. After the second roll has reached the desired diameter size, a tip part is cut into the web by a water jet. The tip part is blown into contact with the additional roll, whereupon the web is cut off by the water jet.

9 Claims, 4 Drawing Sheets

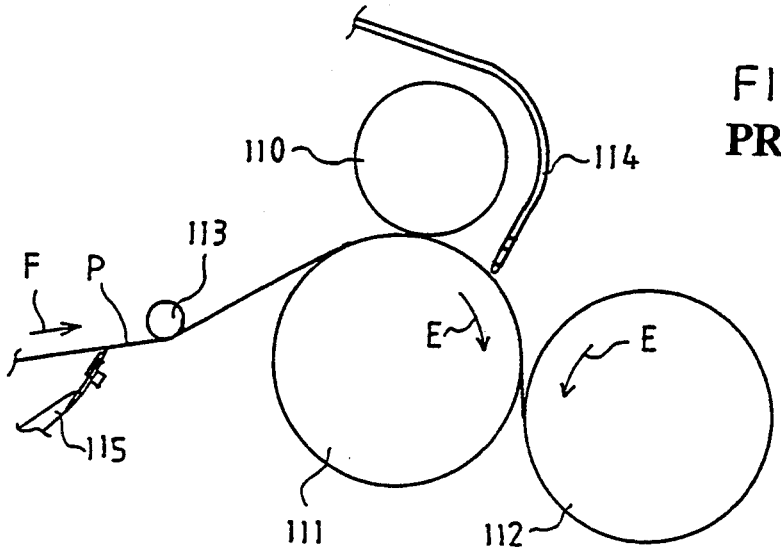
FIG. A1
PRIOR ART
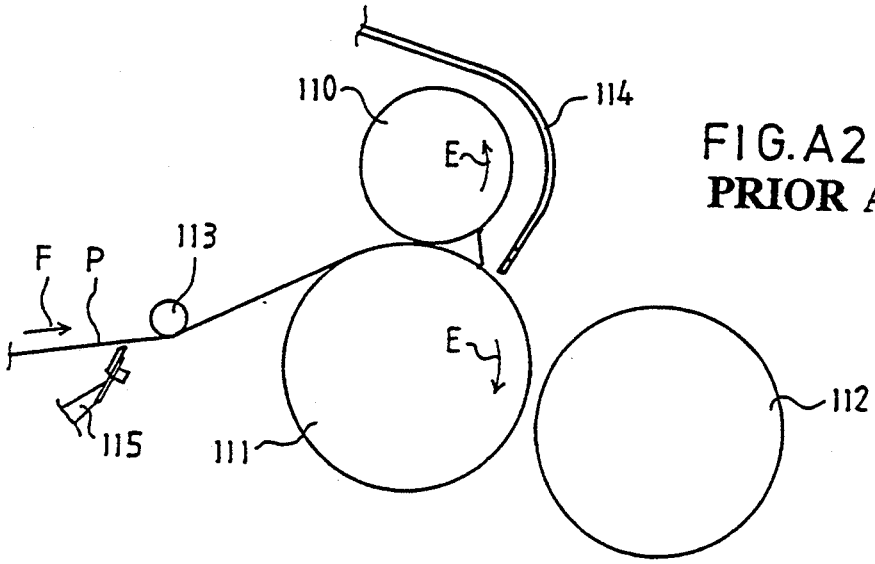
FIG. A2
PRIOR ART
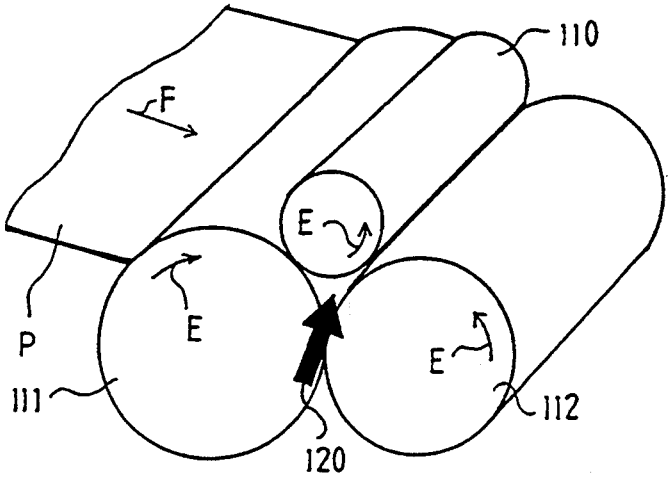
FIG. C
PRIOR ART

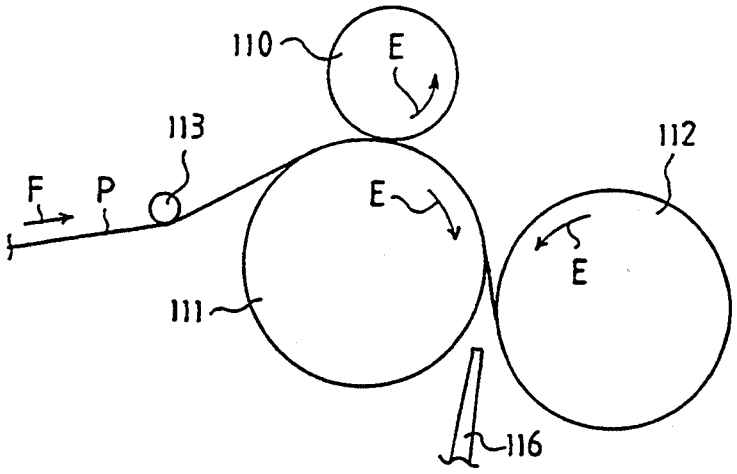
FIG. B1
PRIOR ART
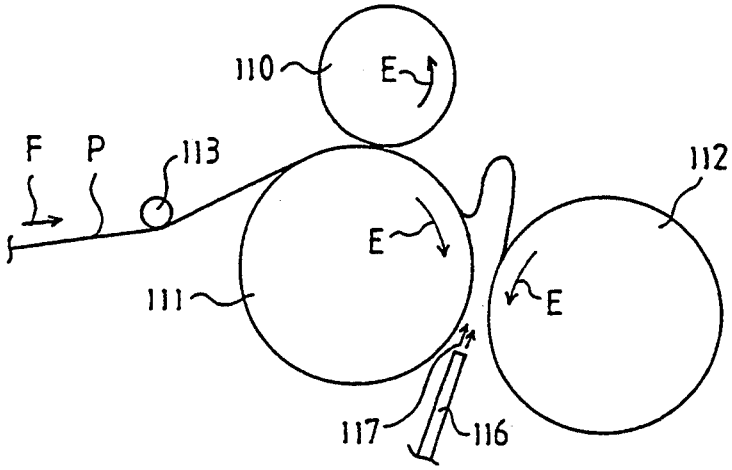
FIG. B2
PRIOR ART
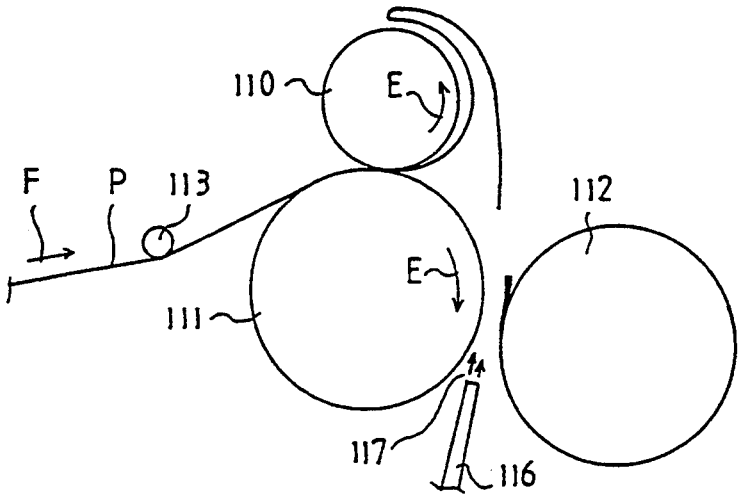
FIG. B3
PRIOR ART

METHOD AND DEVICE FOR REELING A WEB

BACKGROUND OF THE INVENTION

The invention relates to a method in the reeling of a web, wherein the web is reeled by means of a first roll onto a second roll. When the second roll has reached the desired diameter size, a new reeling is started from the first roll onto a new second roll.

The invention also relates to a device for reeling a web from a first roll onto a second roll. When the second roll has reached a desired diameter size, the second roll is replaced by a new second roll onto which the web will be wound.

In the reel-up of a continuously operating paper machine, coating machine, or equivalent, when the reeled jumbo roll becomes full or reaches the desired size, the web will change from winding onto the full roll to winding onto an empty roll at full running speed of the paper machine, coating machine or equivalent. In such a case, reliability of operation is required in order that the operation of the machine is not interrupted from the cutting-off of the web and to its change onto the new roll.

A prior art method for the change of the web in a continuous reel-up is illustrated in FIGS. A1 and A2. As is shown in FIG. A1, a web P is reeled over a roll 111 onto a second roll 112. FIG. A1 is a schematic illustration of a situation in which the roll 112 has become full or reached the desired size. By means of a pin 115, a cut is made into the web P, and the web P starts to tear forming a wedge-shaped leading edge. Air is blown against the reeling cylinder by means of an air blow member 114 towards the web P after the nip formed by the new roll 110 and the reeling cylinder 111. At the cut made by the pin 115, the wedge-shaped leading edge, which is situated at the side of the arriving web P, is wound around the empty roll 110. The blow member 114 operates so that it also directs auxiliary blowings towards the sides of the web. These blowings cause the wedge-shaped leading edge to spread towards both edges of the web so that the web is torn.

However, in this prior art method, problems arise from the fact that the web is not always torn in the same way. The operation of the method is uncertain and may result in web breaks which require stopping the operation of the machine. It is a further limitation of this prior art method that it is only suitable for use with paper qualities of a weight lower than a certain grammage.

FIGS. B1 to B3 illustrate a second prior art method for changing the winding of a web in a continuous reel-up. In this prior art method, after the roll 112 has become full or reached the desired diameter, blowing is applied through the gap between the rolls by means of a blow member 116 from underneath the rolls 111 and 112. The web P starts forming a bag upwards. After the bag has become sufficiently large, it starts winding around a new empty roll 110. Finally, the web is broken and starts winding onto the new roll 110.

In this prior art method, the cutting-off of the web is uncontrolled. At the same time, owing to the slowness of the change process, the topmost layers on the full roll may become slack, which leads to a deterioration in the quality of the roll. Also, this prior art method is very noisy because of the high blow capacity that is required and, moreover, uncontrolled cutting-off of the web may cause standstills in the operation of the machine.

FIG. C illustrates a third prior art method in which to cut off the web and change it from a full roll 112, or from a roll of desired diameter, onto a new, empty roll 110, blowing is applied to the ends of the rolls. This blowing produces a tearing of the web P from the lateral direction and starts a winding of the web onto the empty roll 110. In this prior art method, controlled tearing of the web is unreliable, and may cause disturbance or standstills in the operation of the machine.

OBJECTS AND SUMMARY OF THE INVENTION

An object of the present invention is to provide a new and improved method and device to change the reeling of a web from a roll of desired size onto a second roll in which the drawbacks of the prior art methods and devices are eliminated.

It is a further object of the invention to provide a new and improved method and device for reeling a web that is suitable for the reeling of paper qualities of both high and low grammage.

In view of achieving the objects stated above and those that will come out later, the method in accordance with the invention is mainly characterized in that, after a roll has reached the desired diameter size, a tip part is cut into the web by means of a water jet or water jets. The tip part is blown into contact with the roll, whereupon the web is cut off by means of the water jet or water jets.

In a method in accordance with the invention, the web can be cut off under control and, at the same time, be passed under control onto an additional roll, whereby the reliability of operation of the paper or coating machine or equivalent is increased. Moreover, the method in accordance with the invention is suitable for use in connection with the reeling of both thin and thick paper qualities.

In a device in accordance with the invention, at least one water jet is arranged on a frame. The water jet blows water onto a web in proximity to a first roll. The web is being reeled past the water jet and is winding from the first roll onto a second roll. When the water from the water jet contacts the web, the web is cut. A blow member blows the cut part of the web onto a third roll when a desired diameter size of the second roll is reached. The web ceases to wind onto the second roll which is then removed. The third roll replaces the second roll so that the web is then reeled onto the third roll. The process can be repeated once the third roll has reached the desired diameter size and the third roll replaced by another empty roll.

BRIEF DESCRIPTION OF THE DRAWINGS

The following drawings are illustrative of embodiments of the invention and are not meant to limit the scope of the invention as encompassed by the claims.

FIGS. A1 and A2 show a prior art device for reeling a web.

FIGS. B1, B2 and B3 show a second prior art device for reeling a web.

FIG. C shows a third prior art device for reeling a web.

Figure 1:
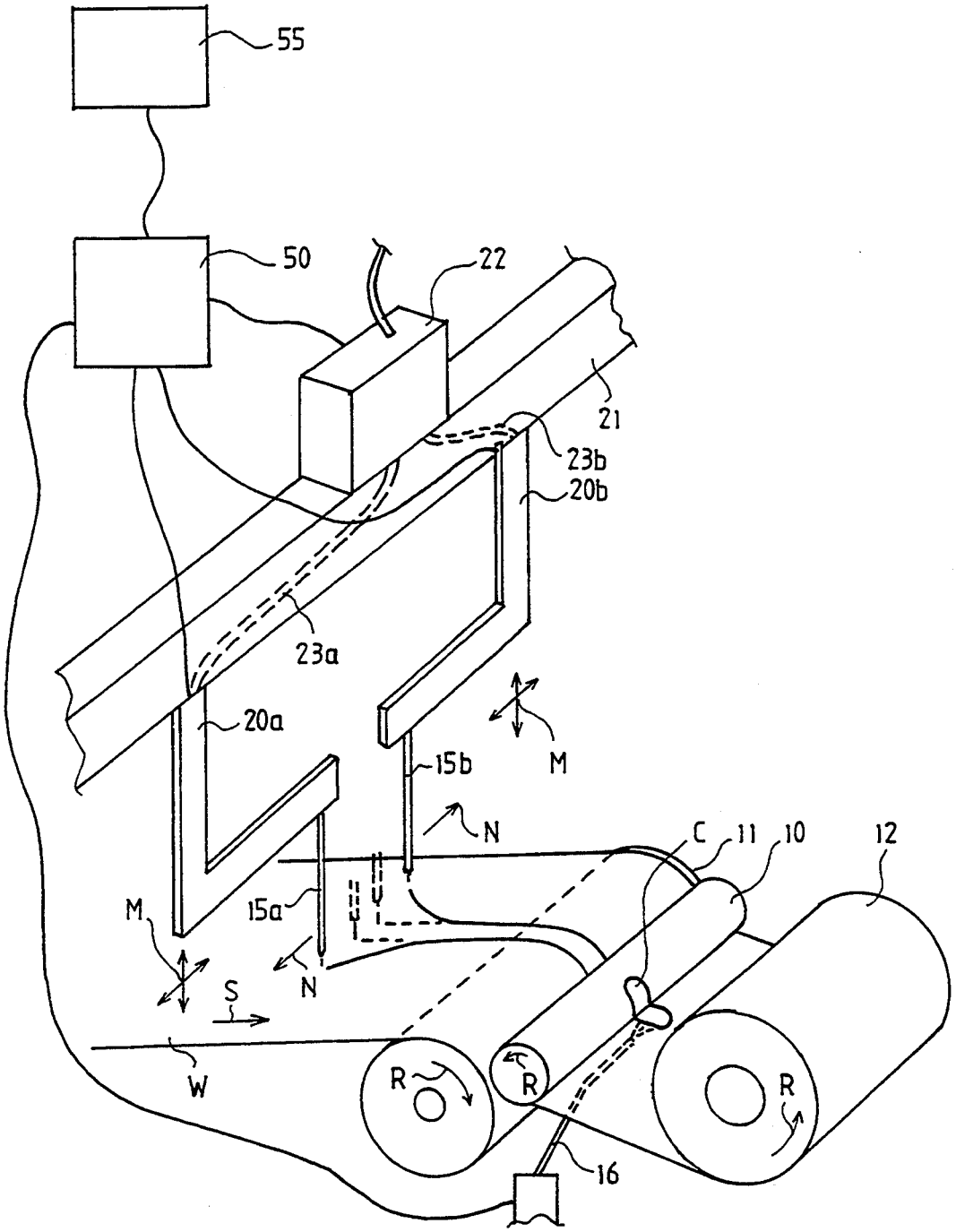

FIG. 1 is a schematic illustration of a device in accordance with the invention for performing a method in accordance with the present invention.

Figure 2A:
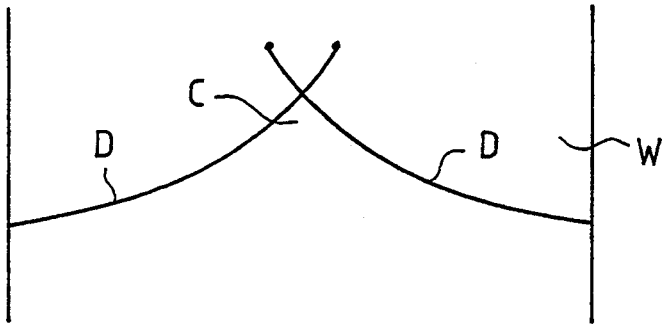
Figure 2B:
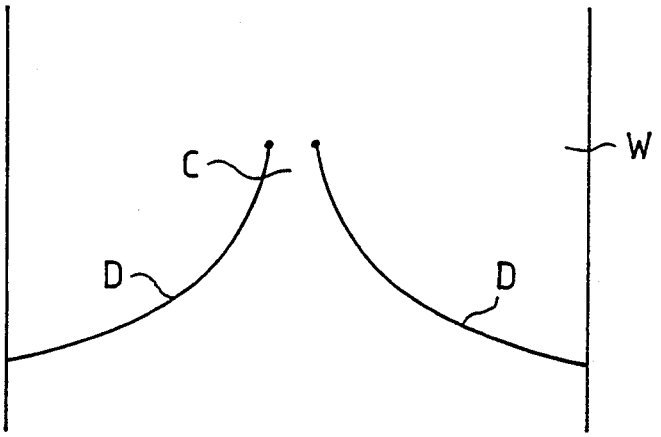
Figure 2C:
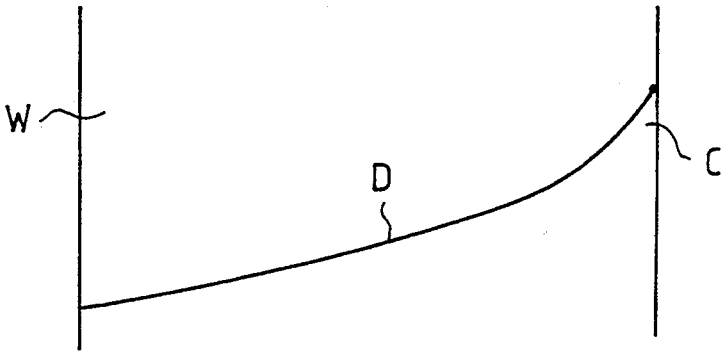

FIGS. 2A, 2B and 2C are schematic illustrations of a web illustrating different possible cutting paths that may be used in the method in accordance with the present invention.

DETAILED DESCRIPTION OF THE INVENTION

Referring to FIG. 1, a web W is reeled by means of a first revolving roll 11 onto a second revolving roll 12. At the stage illustrated in FIG. 1, the reeling of the web W onto the second revolving roll 12 is finished after the roll has become full or reached the desired diameter size. The roll 12 is then shifted to an exchange position as shown in FIG. 1, and a new second revolving roll 10 is brought into nip contact with the first roll 11. The directions of rotation of the rolls 10,11,12 are denoted with the reference arrows R, and the running direction of the web W with the reference arrow S.

By means of water jet nozzles 15*a*,15*b*, a wedge-shaped tip part C is cut into the web W. By means of a blow member 16 placed at an opposite side of the web W, opposite with respect to the water jet nozzles, the wedge-shaped tip part C of the web W is blown so that the web W winds around a new second roll 10. The blow member 16 may comprise an air jet, fan or other suitable blowing mechanism such as an air jet nozzle. Furthermore, the blow member can be arranged to blow the tip part into contact with roll 10 only when the reeling of the web is being transferred from roll 12 to roll 10.

The water jet nozzles 15*a*,15*b* are supported on a frame construction 21 of a paper machine, coating machine or equivalent, by an intermediate of support parts 20*a*,20*b*. The support parts 20*a*,20*b* are arranged so that the water jet nozzles 15*a* and 15*b* move in the directions of the arrows M. In the embodiment illustrated in FIG. 1, the water jet nozzles 15*a*,15*b* move in the directions indicated by the arrows N towards the edges of the web. The water jet nozzles 15*a*,15*b* may also be arranged to be mobile in a vertical direction perpendicular to a plane of the web W in order that the water jet nozzles 15*a* can be raised from the operating position shown in FIG. 1 to a rest position further apart from the web W.

The water jet nozzles 15*a*,15*b* are connected with a drive and control equipment 22 which may also include a water tank. The drive and control equipment 22 control the movement of the water jets 15*a*, 15*b* in the directions indicated by the arrows M. Control equipment 50 controls and operates both the drive and control equipment 22 and the path control and blow equipment 16 in order to operate the water jets in an advantageous manner. The control equipment 50 may also be connected with control equipment 55 of the paper machine concerned. The water jets 15*a*,15*b* and blow equipment 16 may also be controlled manually.

In other embodiments, the control and drive equipment may be accomplished in a number of other ways in themselves known. The connections between the control devices illustrated in FIG. 1 are schematic illustrations.

FIGS. 2A and 2B illustrate the cutting paths D of the water jet nozzles when two nozzles are employed. In FIGS. 2A and 2B, a wedge-shaped tip part C becomes wider from the middle of the web W towards the edges. By means of the water jet, it is possible to start cutting, and the tip part C may be cut fully apart by providing that the cutting paths D of the water jet nozzles intersect each other, as is shown in FIG. 2A, or so that the end of the wedge-shaped tip part C is in contact with the web W, as is shown in FIG. 2B. In FIG. 2B, the tip part C is detached from the rest of the paper web W, e.g. by means of the blowing shown in FIG. 1, whereby the tip part C is blown around the new second roll 10.

It is also possible to employ only one water jet nozzle in the cutting operation. In this manner, the cutting path D is formed in accordance with the illustration in FIG. 2C, i.e. the cutting is started from one edge of the web W, a wedge-shaped tip part C is formed, and the cutting path D is passed to the opposite edge of the web W.

In another embodiment of the present invention, the web W is cut off by means of a high-pressure water jet, in which the pressure of the high-pressure water jet is about 400 to about 600 bars. When two water jet nozzles are employed, they move at a speed of about 10 meters per second, while the speed of the paper web placed underneath is about 1500 meters per minute.

The control equipment 50 can coordinate the blowing of the water jets and the blowing of the blow member 16 so that water is blown by means of the water jets when a desired diameter size of the second roll is reached. At the same time, air is blown by means of the blow member to blow the tip part of the web onto the third roll. In this manner, the blow member 16 and water jets will operate only when then web is being shifted from winding onto roll 12 to winding onto roll 10. When the reeling of the web shifts from roll 12 onto roll 10, roll 12 is moved away and roll 10 placed into nip contact with roll 11.

The examples provided above are not meant to be exclusive. Many other variations of the present invention would be obvious to those skilled in the art, and are contemplated to be within the scope of the appended claims.

What is claimed is:

1. A method for reeling a web, comprising the steps of:

reeling a web from a first roll onto a second roll, initiating the cutting and forming of a tip part from the web by directing one water jet against the web at a first edge thereof, blowing the tip part into contact with a third roll, such that the tip part of the web begins to reel onto the third roll, and directing said water jet to a second edge of the web opposite from said first edge to sever the web across its entire width so that the web stops reeling onto the second roll and begins to reel onto the third roll.

2. A method as claimed in claim 1, further comprising the steps of shifting the second roll to an exchange position and bringing the third roll into nip contact with the first roll.

3. A device for changing the reeling a web from successive rolls, comprising a frame, a first roll arranged to reel a web onto a second roll, water nozzle means arranged on said frame for directing a water jet onto the web in proximity to the first roll to initiate the cutting and forming of a tip part into the web, said water nozzle means consisting of one water jet positioned to start cutting the web at one edge thereof and ending at an opposite edge of the web, and air nozzle means arranged on said frame for directing an air jet onto the tip part of the web to direct the tip part onto a third roll when a desired diameter size of the second roll is reached, said water nozzle means further constituting means to direct said water jet across the entire width of the web after the tip part has been reeled around the third roll to sever the web and stop the web from reeling onto the second roll, the web then being reeled onto the third roll.

4. A device as claimed in claim 3, further comprising movement means for moving said water jet across the width of the web.

5. A device as claimed in claim 4, wherein said movement means move said water jet in a perpendicular direction to the running direction of the web.

6. A device as claimed in claim 4, wherein said movement means comprise drive and control equipment.

7. A device as claimed in claim 4, wherein said movement means move said water jet at a speed of about 10 meters per second.

8. A device as claimed in claim 3, further comprising control equipment to coordinate the operation of said water jet such that said water jet is directed at the web when a desired diameter size of the second roll is reached.

9. A device as claimed in claim 3, wherein said water jet is a high-pressure water jet having a pressure of from about 400 bars to about 600 bars.

* * * * *